United States Patent [19]

Johnson et al.

[11] 4,000,025

[45] Dec. 28, 1976

[54] INCORPORATING BALLISTIC MODIFIERS IN SLURRY CAST DOUBLE BASE CONTAINING COMPOSITIONS

[75] Inventors: Craig E. Johnson, Indian Head; Larry D. Henderson, Oxon Hill, both of Md.

[73] Assignee: The United States of America as represented by the Secretary of the Navy, Washington, D.C.

[22] Filed: May 28, 1974

[21] Appl. No.: 475,329

[52] U.S. Cl. ..... 149/19.93; 149/19.8; 149/19.92; 149/96; 149/98; 149/100; 149/110

[51] Int. Cl.[2] ..... C06B 21/00; C06B 25/24

[58] Field of Search ..... 149/19.93, 19.92, 110, 149/98, 100, 96, 19.8

[56] References Cited

UNITED STATES PATENTS

| | | | |
|---|---|---|---|
| 2,970,046 | 1/1961 | Cutforth | 149/19.93 X |
| 3,022,149 | 2/1962 | Cramer | 149/19.93 X |
| 3,033,718 | 5/1962 | Preckel | 149/100 |
| 3,138,499 | 6/1964 | Camp et al. | 149/38 |
| 3,734,788 | 5/1973 | Kaufman | 149/19.92 X |
| 3,855,373 | 12/1974 | Swotinsky et al. | 149/100 X |
| 3,860,462 | 1/1975 | Sayles | 149/98 X |

*Primary Examiner*—Edward A. Miller

[57] ABSTRACT

Ballistic modifiers of up to one micron in size are slurried and mixed with a high impulse propellant slurry in order to produce a high impulse propellant having a plateau or mesa burning characteristic.

7 Claims, No Drawings

INCORPORATING BALLISTIC MODIFIERS IN SLURRY CAST DOUBLE BASE CONTAINING COMPOSITIONS

BACKGROUND OF THE INVENTION

This invention relates to a propellant and method, and more particularly to a propellant having a plateau or mesa burning characteristic due to the presence of at least one burning rate modifier having a particle size of up to 1 micron.

It is well known in the prior art to add certain types of finely divided additives to propellants in order to modify their performance in some way. Many different types of additives are known. It is desirable to modify high impulse propellants in order to control the burning rate thereof. However, many difficulties arise in the preparation of high impulse propellants due to their sensitivity. When the burning rate of a high impulse propellant is plotted against combustion pressure on a logarithmic graph, the resultant graph approximates a straight line. If a high impulse propellant is to be used in a rocket, the straight line indicates that the rocket nozzle must be designed carefully to avoid problems with burning rate and pressure build up. If the nozzle is not designed properly, the propellant may not burn, or the propellant may burn too fast, build up pressure, and explode. All of these features render an otherwise desirable high impulse propellant unattractive. It is desirable that, for a given pressure range, the burning rate not increase (plateau) and sometimes even decrease with increasing pressure (mesa). If a propellant is appropriately formulated to produce a plateau or mesa burning characteristic, nozzle design is not so critical in a rocket motor. In the past burning rate modifiers have not been able to effectively modify high impulse propellants when prepared by a slurry cast process as desired.

SUMMARY OF THE INVENTION

It is, therefore, an object of this invention to provide a composition suitable for use as a high impulse propellant.

Also it is an object of this invention to provide a composition suitable for use as a modified high impulse propellant.

It is a further object of this invention to provide a composition suitable for use as a high impulse propellant having a mesa burning characteristic.

It is a still further object of this invention to provide a composition suitable for use as a high impulse propellant having a plateau burning characteristic.

Another object of this invention is to provide a method for combining at least one burning rate modifier having a particle size of up to 1 micron with a high impulse propellant.

Yet another object of this invention is to provide a method of combining a slurry of a burning rate modifier with a slurry of a high impulse propellant.

These and other objects of the invention are met by providing a first slurry of at least one burning rate modifier having a particle size of up to one micron and mixing the first slurry with a second slurry of a high impulse propellant in order to form a high impulse propellant having either a plateau or mesa burning characteristic.

DETAILED DESCRIPTION OF THE PREFERRED EMBODIMENT

To form a modified propellant according to the present invention, a slurry of the propellant is mixed with a slurry of the burning rate modifier after the modifier is reduced to a particle size of up to one micron.

The standard high impulse propellants are highly suitable for a wide variety of applications. Yet the increase of burning rate with increase of pressure produces a substantial number of problems. Attempts to avoid these problems by standard techniques such as merely adding burning rate modifiers to a slurry of the high impulse propellants are not effective. It has now been found that the use of burning rate modifiers having a particle size of up to 1 micron in the form of a slurry in combination with a slurry of high impulse propellant produces the desired plateau or mesa burning characteristic. While it is not desired to be bound by any particular theory for the modification of the burning rate in the high impulse propellant, it is postulated that the burning rate modifier undergoes a chemical change at a given temperature which produces the plateau or mesa burning characteristic. The modifier may undergo a phase change in order to absorb energy, or it may produce a gaseous product which undergoes secondary burning. Without this reduction of the burning rate modifier to particle sizes up to one micron prior to use in the high impulse propellant, the particles of burning rate modifier do not completely gasify at the flame front. Therefore, the mesa or plateau burning characteristic is not obtained. However, burning rate modifiers of up to one micron in particle size do produce the desired plateau or mesa burning characteristic.

Suitable high impulse propellants containing the burning rate modifier of up to 1 micron particle size are those containing aluminum, cyclotetramethylenetetranitramine (HMX) or ammonium perchlorate. Other suitable high impulse propellants contain nitrocellulose (11.0 to 13.65% nitrogen), nitroglycerine (NG), metriol trinitrate (MTN), triethylene glycol dinitrate (TEGDN), butane triol trinitrate (BTTN), and sorbitol pentanitrate (SPN).

Suitable burning rate modifiers include lead and copper salts having a particle size of up to one micron. Also azobisformamides such as those disclosed in Ser. No. 459,421 filed Apr. 4, 1974 are suitable burning rate modifiers. Copper (II) chloride, lead stearate, and lead chloride are especially suitable burning rate modifiers. Other suitable burning rate modifiers include copper beta resorcylate, lead beta resorcylate, copper salicylate and lead salicylate.

A problem created by the hydrolysis of the salts when incorporated in a high impulse propellant according to solventless extrusion methods of the prior art is solved by forming a first slurry of the burning rate modifier and a second slurry of the propellant using an organic liquid for both slurries, mixing the slurries together, and recovering the propellant having the burning rate modifier incorporated therein by vacuum removal of the organic liquid during mixing or casting. In slurry form, the burning rate modifier is repeatedly ground until the particle size is less than 1 micron. The first slurry is then mixed with the second slurry. A typical organic liquid used to form the first slurry is heptane due to its availability and low cost. However, other organic liquids are suitable so long as they do not hydrolyze the burning rate modifier.

Various other materials which do not interfere with the function of the burning rate modifier may be added to the slurry. For example, a suitable wetting agent is Aerosol OT which is a trade name for dioctyl sodium sulfosuccinate. Typical inert fillers include carbon black.

The following example is intended to illustrate without unduly limiting the invention.

EXAMPLE

A high impulse propellant is prepared in the following manner in order to provide plateau burning characteristics. To a 1 quart ceramic ball mill, 38.14 grams of monobasic copper beta resorcylate, 454 grams of heptane and 8 tungsten carbide balls of ½ inch diameter are added. The thus loaded ball mill is rotated for 12 days thereby providing copper beta resorcylate having a particle size of up to and including 1 micron. Substantially no particles of copper beta resorcylate are larger than one micron. The ball mill product, copper beta resorcylate, is then placed in a glass breaker and ultrasonically treated for 1 hour in order to disperse the small agglomerated particles which form on milling. After the ultrasonic treatment, the mixture of heptane and copper beta resorcylate are added slowly with stirring to a swirling mass comprising 48 pounds of heptane, 7.87 pounds of water wet nitrocellulose containing 12.6% nitrogen. Further additions to the composition thus formed include 5.45 grams of candellina wax, 4.8 pounds of metriol trinitrate as a plasticizer, 0.6 pound of triethylene glycol dinitrate, 0.12 pound of dinormal proply adipate and 0.24 pound of 2 nitro diphenylamine. The whole mass is slurried in a Cowles mixer for 6 hours to form a propellant. The propellant is then dried one day at ambient temperature, cured 2 days at 140° F, and cured 2 days at 170° F. After curing is complete, the propellant is extruded into ¼ inch strands. Upon burning, the propellant exhibits a plateau which is not present in the absence of the copper beta resorcylate.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A method for imparting a plateau or mesa burning characteristic to a high impulse double base or composite-modified double base propellant wherein the improvement comprises:

a. providing a first slurry comprising at least one burning rate modifier and a volatile organic liquid;

b. milling the first slurry until the maximum particle size of the burning rate modifier is less than or equal to 1 micron;

c. mixing the first slurry with a second slurry of a high impulse double base or composite-modified double base propellant in a volatile organic liquid; and d. drying and curing the resultant mixture.

2. The method of claim 1 wherein the burning rate modifier is copper II chloride.

3. The method of claim 1 wherein the burning rate modifier is lead chloride.

4. The method of claim 1 wherein the burning rate modifier is lead stearate.

5. The method of claim 1 wherein the burning rate modifier is at least one compound selected from the group consisting of copper beta resorcylate, lead beta resorcylate, copper salicylate, and lead salicylate.

6. The method of claim 1 wherein the organic liquid of the first slurry and the organic liquid of the second slurry are the same.

7. The method of claim 6 wherein the organic liquid is heptane.

* * * * *